United States Patent [19]

McCleerey et al.

[11] Patent Number: 4,557,543

[45] Date of Patent: Dec. 10, 1985

[54] KEY HOLE RETENTION

[75] Inventors: Earl W. McCleerey, Mechanicsburg; John A. Root, Harrisburg, both of Pa.

[73] Assignee: AMP Incorporated, Harrisburg, Pa.

[21] Appl. No.: 715,705

[22] Filed: Mar. 25, 1985

Related U.S. Application Data

[63] Continuation of Ser. No. 163,915, Jun. 27, 1980, abandoned.

[51] Int. Cl.[4] ..... H01R 13/432

[52] U.S. Cl. ..... 339/97 P; 339/217 S

[58] Field of Search ..... 339/217 S, 97 R, 97 P, 339/98, 99 R

[56] References Cited

U.S. PATENT DOCUMENTS

| | | | |
|---|---|---|---|
| 3,083,345 | 3/1963 | Scheller | 339/47 |
| 3,538,489 | 11/1970 | Bennett et al. | 339/198 |
| 3,544,954 | 12/1970 | Yeager | 339/217 |
| 3,601,775 | 8/1971 | Longnecker et al. | 339/217 S |
| 3,617,991 | 11/1971 | Shlesinger, Jr. | 339/217 J |
| 3,764,960 | 10/1973 | Heimbrock | 339/217 S |
| 3,959,868 | 6/1976 | Mathe | 339/97 P |
| 4,159,160 | 6/1979 | Plyler et al. | 339/217 S |

FOREIGN PATENT DOCUMENTS

| | | | |
|---|---|---|---|
| 93843 | 5/1969 | France | 339/217 S |
| 2024538 | 1/1980 | United Kingdom | 339/217 S |

*Primary Examiner*—John McQuade

*Attorney, Agent, or Firm*—Russell J. Egan; F. Brice Faller

[57] ABSTRACT

An improved system is disclosed for retaining electrical terminals in associated housings. The subject retention system provides captivation of terminals in a housing in such fashion that the terminals can be mass terminated by known means and can be individually removed for repair or replacement by insertion of a simple tool. The subject retention system can best be compared to a butterfly extension on the terminal and a key hole in the connector. This serves both as orienting and stabilizing means while allowing limited float to improve matability.

4 Claims, 6 Drawing Figures

KEY HOLE RETENTION

This application is a continuation of application Ser. No. 163,915 filed 6/27/80, now abandoned.

BACKGROUND OF THE INVENTION

1. THE FIELD OF THE INVENTION

The present invention relates to a system for removably retaining electrical terminals in associated housings.

2. The Prior Art

Much work has been done on methods and means for removably securing electrical terminals in connector housings. The resulting devices are generally classified as front release devices, as noted by U.S. Pat. No. 3,083,345 and rear release devices, as shown by U.S. Pat. No. 3,544,954. Some devices are capable of either front or rear release, as shown by U.S. Pat. No. 3,617,991. A further category would be side release, as shown in U.S. Pat. No. 3,538,489 and of which the present invention constitutes a particular improvement.

SUMMARY OF THE INVENTION

The present invention pertains to a retention system for removably securing an electrical terminal in an associated housing. The subject retention system includes a pair of L-shape flanges which extend normally from the terminal with the integral leg of the flanges being parallel and the free legs mutually diverging. A key hole shaped passage is formed in a sidewall of the housing to receive the flanges. The divergent arms engage shoulders formed by an aperture intersecting the passage and providing access to release the subject retention system.

It is therefore an object of the present invention to produce an improved retention system for retaining electrical terminals in associated housings.

It is another object of the present invention to produce an improved retention system which allows the terminals to float thereby improving matability.

It is still another object of the present invention to produce an improved retention system which can be used in combination with a wide variety of known electrical terminals to provide an improved retention system.

It is a further object of the present invention to produce an improved retention system which is independent of the wire barrel so that the wire barrel may be fully stuffed with conductors without affecting the release or accessibility of the retention system.

It is a still further object of the present invention to produce an improved retention system for electrical terminals which system can be added to known terminal configurations in an economic and easily manufactured fashion.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
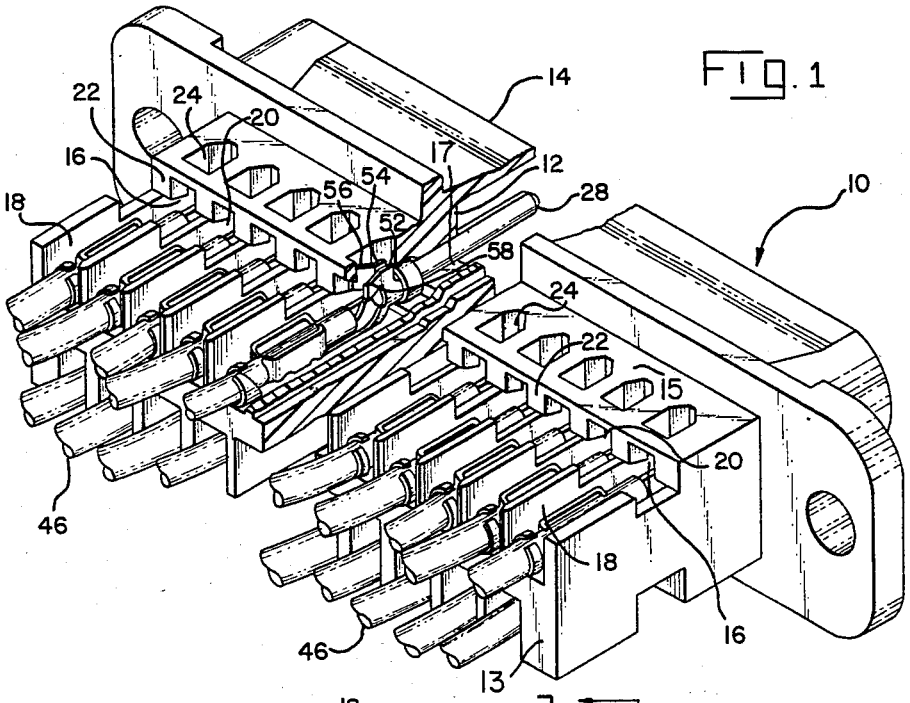
FIG. 1 is a perspective view, partly in section, of an electrical connector embodying the present invention.

The subject invention is shown in the Figures in combination with an electrical connector housing and terminal of known type. The housing 10 has a forward mating face 12 enclosed in a shroud 14 an opposed rear terminal receiving face 13, and two parallel rows of terminal receiving passages 16 and two opposed outer surfaces 15 extending therebetween.

Each passage 16 has a forward portion 17 adjacent the mating face 12, an open rear portion 18 opening on the adjacent outer sidewall 15 adjacent the terminal receiving face 13, and a retention portion therebetween. The retention portion of each passage 16 has a key hole profiled entry portion toward the rear face 13, a slot 20 formed in transition wall 22 extending radially toward the adjacent outer surface 15. A profiled aperture 24 extends from the adjacent outer surface 15 of the connector to intersect the passage 16 and form a forward facing shoulder 19 on either side of slot 20, see FIG. 3.

Figure 6:
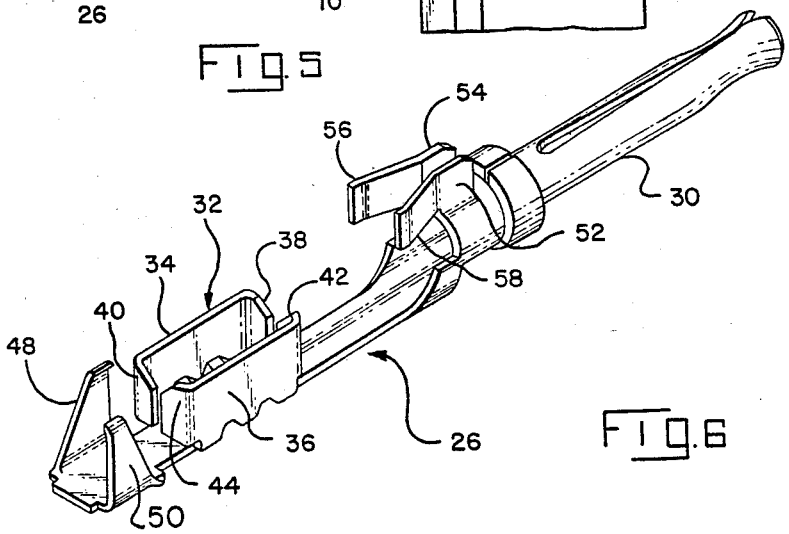
FIG. 6 is a perspective view of a terminal embodying the subject invention.

Each terminal 26, see FIG. 6, has a cylindrical mating front portion received in the forward portion 17 of a passage 16. This can be a pin 28, as shown in FIGS. 1, 2, 4 and 5 or a socket 30, as shown in FIG. 6. Each terminal 26 includes a conductor engaging rear portion 32 received in the open rear portion 18 of a passage 16. The rear portion 32 includes a pair of spaced sidewalls 34, 36 each having inwardly turned ends 38, 40, 42, 44 which define therebetween a pair of spaced slots adapted to effect an insulation piercing termination of an insulated conductor 46. Each terminal also includes a pair of strain relief crimp ears 48, 50. The configuration and operation of this portion of the terminal is fully described in U.S. patent application Ser. No. 927,720, filed July 25, 1978, and now abandoned the disclosure of which is incorporated herein by reference.

Intermediate the mating front and conductor engaging rear portions of each terminal is the retention portion, which is received in retention portion of a passage 16. This retention portion is best seen in the perspective view of FIG. 6 and preferably is formed integrally with the remainder of the terminal. The subject retention means includes a pair of adjacent symmetric flanges 52, 54 having first portions which are substantially coplanar with the axis of the cylindrical mating portion and extend radially beyond the cylindrical mating portion toward the adjacent outer surface 15. The flanges 52, 54 have respective second portions 58, 56 extending freely rearward from respective first portions and mutually diverging to free ends which about respective shoulders 19.

Figure 2:
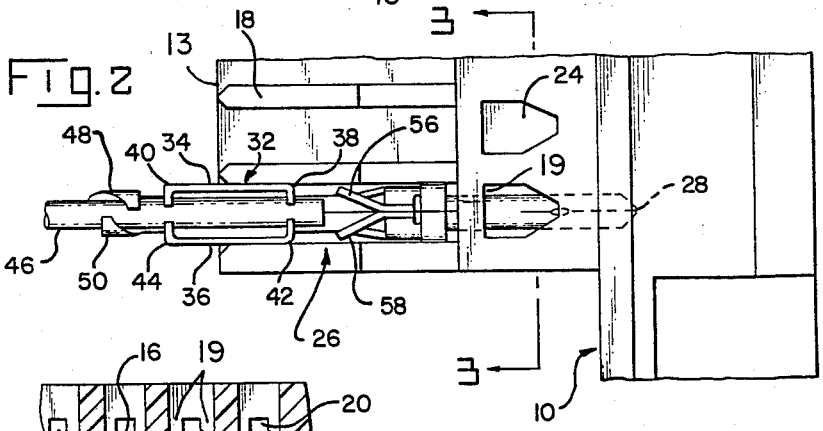
FIG. 2 is a plan view of one end of the connector of FIG. 1 showing a terminal in a partially inserted condition.
Figure 3:
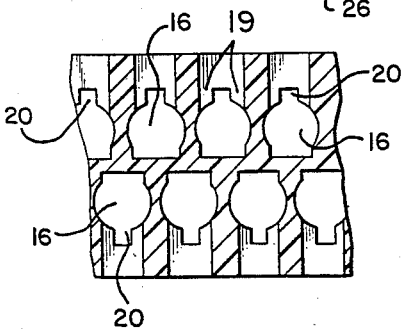
FIG. 3 is a cross section taken along line 3—3 of FIG. 2 showing the shape of the terminal passage.
Figure 4:
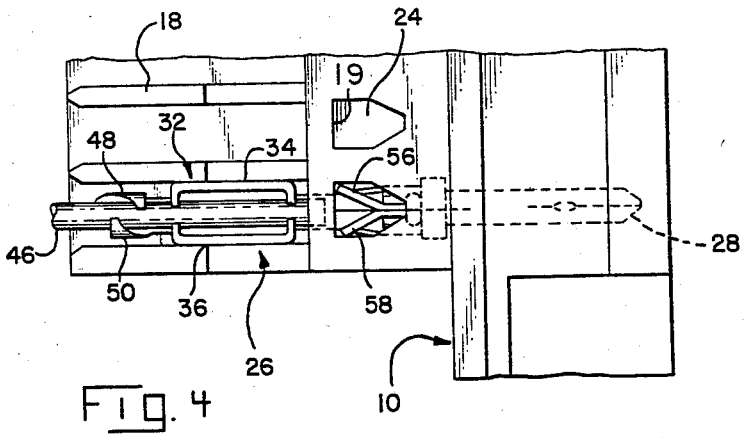
FIG. 4 is a view similar to FIG. 2 showing the terminal in a fully inserted condition.
Figure 5:
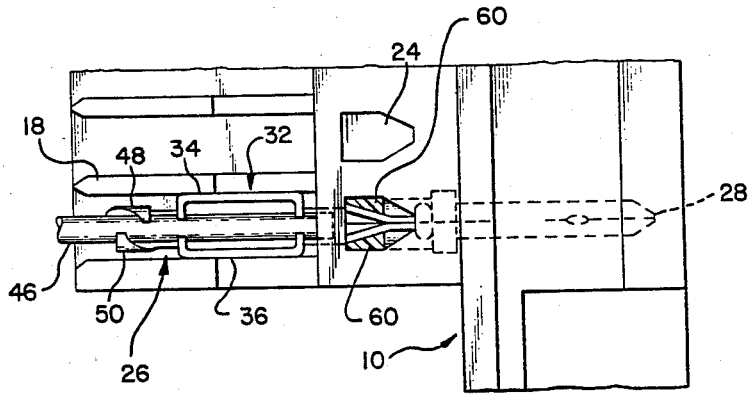
FIG. 5 is a view similar to FIGS. 2 and 4 showing an extraction tool in place aligning the terminal for removal.

It will be seen from FIGS. 1, 2, and 3 that the diverging arms 56, 58 will be compressed during the insertion of the terminal through the slot 20 and will expand to engage the shoulders formed by the intersection with the shaped aperture 24 and will retain the terminal therein. The terminal 26 can be removed from the connector by inserting a bifurcated tool 60 into the profiled aperture 24 to compress the legs 56, 58 to the width of the slot 20 allowing the rearward removal of the terminal from the passage 16 and slot 20.

It should be noted that the subject retention system also serves as a stabilizing and orientation means for the terminals when they are inserted into the housing.

The present invention may be subject to many modifications and changes without departing from the spirit or essential characteristics thereof. The present embodiment is therefore to be considered in all respects as illustrative and not restrictive of the scope of the invention.

What is claimed is:

1. An improved pin and socket type connector comprising:

an insulative housing having a forward mating face, an opposed rear terminal receiving face, and two parallel rows of terminal receiving passages and two opposed outer surfaces extending therebetween, each passage having a forward portion adjacent the mating face, an open rear portion opening on the adjacent outer surface adjacent the terminal receiving face, and a retention portion therebetween, the retention portion of each passage having a key hole profiled entry portion toward the rear face, the entry portion comprising a slot extending radially toward the adjacent outer surface, the retention portion being intersected by an aperture extending from the adjacent outer surface into the passage adjacent the entry portion forming a forward facing shoulder on either side of the slot;

a plurality of stamped and formed terminals mounted in respective passages, each having a cylindrical mating portion received in the forward portion of a passage, an open insulation displacing conductor engaging rear portion received in the open rear portion of the passage, and a retention portion therebetween received in the retention portion of the passage, the retention portion of each terminal comprising a pair of adjacent symmetric flanges having first portions which are substantially coplanar with the axis of the cylindrical mating portion and extend radially beyond the cylindrical mating portion toward the adjacent outer surface, the flanges having respective second portions extending freely rearward from respective first portions and mutually diverging to free ends which abut respective shoulders.

2. A connector according to claim 1 wherein each said aperture has opposed sidewalls which converge toward the mating face of the connector.

3. A connector according to claim 2 wherein said sidewalls converge to an endwall opposite said shoulders, the width of said end wall being at least twice the thickness of the first portion of the flanges.

4. A connector according to claim 1 wherein each outer surface has a channel therein extending across the open rear portions of the passages adjacent the retention portions thereof, the slot in each entry portion having opposed sidewalls which converge from the channel toward the aperture.

* * * * *